US012064078B2

(12) United States Patent
Chang et al.

(10) Patent No.: US 12,064,078 B2
(45) **Date of Patent: *Aug. 20, 2024**

(54) CLEANER SYSTEM

(71) Applicant: LG Electronics Inc., Seoul (KR)

(72) Inventors: Daeho Chang, Seoul (KR); Ingyu Yang, Seoul (KR); Donggeun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 413 days.

This patent is subject to a terminal disclaimer.

(21) Appl. No.: 17/556,325

(22) Filed: Dec. 20, 2021

(65) Prior Publication Data

US 2022/0110496 A1 Apr. 14, 2022

Related U.S. Application Data

(63) Continuation of application No. 17/496,456, filed on Oct. 7, 2021.

(30) Foreign Application Priority Data

Oct. 7, 2020 (KR) ..... 10-2020-0129579
Aug. 19, 2021 (KR) ..... 10-2021-0109308

(51) Int. Cl.

| | |
|---|---|
| ***A47L 9/14*** | (2006.01) |
| ***A47L 5/24*** | (2006.01) |
| ***A47L 9/00*** | (2006.01) |
| ***A47L 9/28*** | (2006.01) |

(52) U.S. Cl.

CPC ..... *A47L 9/149* (2013.01); *A47L 5/24* (2013.01); *A47L 9/0063* (2013.01); *A47L 9/1409* (2013.01); *A47L 9/2873* (2013.01)

(58) Field of Classification Search

CPC ..... A47L 9/149; A47L 9/0063; A47L 9/1409; A47L 9/2873; A47L 5/24; A47L 2201/02; A47L 2201/024

USPC ..... 15/300.1, 421

See application file for complete search history.

(56) References Cited

FOREIGN PATENT DOCUMENTS

| | | | |
|---|---|---|---|
| DE | 102015100057 A1 * | 7/2016 | ..... A47L 5/24 |
| JP | 2016116852 | 6/2016 | |
| JP | 2017189453 | 10/2017 | |
| JP | 2019005068 | 1/2019 | |
| KR | 20120046928 | 5/2012 | |
| KR | 20170126377 | 11/2017 | |
| KR | 101985314 | 9/2019 | |
| KR | 20200073966 | 6/2020 | |
| KR | 20200074054 | 6/2020 | |

(Continued)

OTHER PUBLICATIONS

International Search Report in International Appln. No. PCT/KR2021/013201, dated Jan. 3, 2022, 9 pages (with English translation).

(Continued)

*Primary Examiner* — David S Posigian
*Assistant Examiner* — Caleb Andrew Holizna
(74) *Attorney, Agent, or Firm* — Fish & Richardson P.C.

(57) ABSTRACT

A cleaner system includes a cleaner and a cleaner station that performs a method for removing residual dust. The cleaner station is configured to suction dust stored in the cleaner. Residual dust in the cleaner station after suctioning dust in a dust bin of the cleaner is suctioned through a bypass hole that penetrates an outside and an inside of a suction tube.

8 Claims, 12 Drawing Sheets

(56) References Cited

FOREIGN PATENT DOCUMENTS

| | | |
|---|---|---|
| KR | 20210002057 | 1/2021 |
| KR | 20210019940 | 2/2021 |

OTHER PUBLICATIONS

Office Action in Korean Appln. No. 10-2022-0094149, dated Oct. 6, 2022, 15 pages (with English translation).
Notice of Allowance in Korean Appln. No. 10-2021-0109308, dated Mar. 10, 2022, 4 pages (with English translation).

* cited by examiner

CLEANER SYSTEM

CROSS-REFERENCE TO RELATED APPLICATIONS

This application is a continuation of U.S. application Ser. No. 17/496,456, filed on Oct. 7, 2021, which claims the priority benefit of Korean Patent Application No. 10-2020-0129579, filed on Oct. 7, 2020, and Korean Patent Application No. 10-2021-0109308, filed on Aug. 19, 2021, the disclosures of which are incorporated herein by reference.

TECHNICAL FIELD

The present disclosure relates to a cleaner system including a cleaner and a cleaner station, and more particularly, to a cleaner system capable of removing dust stored in a cleaner by suctioning the dust into a cleaner station and capable of efficiently removing even residual dust remaining in the cleaner station.

BACKGROUND

A cleaner is an electrical appliance that may draw in small garbage or dust by suctioning air using electricity and receive the garbage or dust in a dust bin provided in the cleaner. For example, the cleaner may include a vacuum cleaner.

The cleaners may be classified into a manual cleaner which is moved directly by a user to perform a cleaning operation, and an automatic cleaner which performs a cleaning operation while autonomously traveling. Depending on the shape of the cleaner, the manual cleaners may be classified into a canister cleaner, an upright cleaner, a handy cleaner, a stick cleaner, and the like.

The canister cleaners were widely used in the past as household cleaners. Recently, there is an increasing tendency to use the handy cleaner and the stick cleaner that include a dust bin and a cleaner main body that are integrally provided to improve convenience of use.

In some cases, the canister cleaner may include a main body and a suction port that are connected by a rubber hose or pipe, and in some instances, the canister cleaner may be used in a state in which a brush is fitted into the suction port.

The handy cleaner may have a portability with a light weight. In some cases, the handy cleaner may have a short length, which may limit its cleaning region. The handy cleaner may be used to clean a local place such as a desk, a sofa, or an interior of a vehicle.

A user may use the stick cleaner while standing and perform a cleaning operation without bending his/her waist. In some examples, the stick cleaner may help the user clean a wide region while moving in the region. While the handy cleaner may be used to clean a narrow space, the stick cleaner may be used to clean a wide space and also used to a high place that the user's hand may not reach. In some cases, the stick cleaner may include modularized stick cleaners. Various types of cleaners are used to clean various places.

In some cases, the stick cleaner has a dust bin with a small capacity for storing collected dust, which may lead to inconveniences for a user because the user may need to empty the dust bin frequently.

In some examples, a cleaning apparatus includes a vacuum cleaner and a docking station. In some cases, after stopping a suction operation, the suction device (e.g., a suction fan) may not remove foreign substances attached to a peripheral portion of the dust collecting container during the suction process. In some cases, a user may need to handle the foreign substances exposed and attached to the peripheral portion of the dust collecting container, with his/her hand when the user uses the vacuum cleaner again after the process of suctioning the foreign substances (hereinafter, referred to as residual dust) is ended. In some cases, the user may experience the inconvenience to directly remove the residual dust with a wet tissue or the like. In some instances, the residual dust may be accumulated in the docking station, which may contaminate the interior of the docking station.

SUMMARY

The present disclosure describes a cleaner system capable of effectively removing residual dust accumulated on an outer portion of a dust bin of a cleaner or an inner portion of a cleaner station during a dust suction process of the cleaner station.

The present disclosure also describes a method for effectively removing residual dust using a cleaner system including a cleaner and a cleaner station.

According to one aspect of the subject matter described in this application, a cleaner system includes a cleaner including a dust bin configured to receive dust and a cleaner station configured to couple to the cleaner and to remove the dust in the dust bin. The dust bin includes (i) a dust bin body that has a cylindrical shape and defines an opening at one side thereof and (ii) a discharge cover rotatably coupled to the dust bin body and configured to cover the opening. The cleaner station includes a housing, a coupling part recessed from a surface of the housing and configured to couple to at least a part of the cleaner, a suction tube disposed in an upward-downward direction in the housing and connected to the coupling part, and a door coupled to the coupling part and configured to rotate relative to the coupling part. The coupling part defines a main hole configured to communicate with an outside of the housing and an inside of the suction tube, where the main hole is defined at a position configured to face the dust bin based on the cleaner being coupled to the coupling part. The coupling part further defines a bypass hole that is located below the main hole and in communication with the outside of the housing and the inside of the suction tube, where the bypass hole is configured to be remain open. The discharge cover is configured to open and close the main hole based on rotation of the door.

Implementations according to this aspect can include one or more of the following features. For example, the cleaner station can include a dust collecting motor accommodated in the housing and configured to generate a suction force for suctioning the dust in the dust bin through the suction tube. The door can be configured to rotate in a first direction relative to the coupling part to thereby open the main hole based on the cleaner being coupled to the coupling part, and rotate in a second direction opposite to the first direction to thereby close the main hole based on completion of an operation of the dust collecting motor.

In some implementations, the dust collecting motor can be configured to operate for a predetermined first time in a state in which the main hole is opened to thereby provide the suction force to both of the main hole and the bypass hole, and after operating for the predetermined first time, operate for a predetermined second time in a state in which the main hole is closed to thereby provide the suction force to the bypass hole. In some examples, the door can be configured to maintain the main hole to be opened for the predetermined first time.

In some implementations, the cleaner station can have (i) a main suction route configured to carry air containing dust into an internal space of the suction tube through the main hole and (ii) a bypass suction route configured to carry air containing dust into the internal space of the suction tube through the bypass hole. The dust collecting motor can be configured to, based on the main hole being opened, suction air containing dust through both of the main suction route and the bypass suction route. The dust collecting motor can be configured to, based on the main hole being closed, suction air containing dust through the bypass suction route.

In some implementations, the door can be configured to rotate relative to the coupling part in a direction from a state in which the main hole is closed, and rotate together with the discharge cover to thereby open or close the dust bin of the cleaner. In some examples, a cross-sectional area of the bypass hole can be less than a cross-sectional area of the main hole. In some examples, the cleaner station can include a push protrusion configured to press the discharge cover to thereby open the dust bin based on the cleaner being coupled to the coupling part, and the bypass hole can be configured to face the push protrusion in a direction in which the push protrusion presses the discharge cover.

According to another aspect, a cleaner station includes a housing configured to couple to a cleaner, a coupling part recessed from a surface of the housing toward an inside of the housing and configured to couple to at least a part of the cleaner, a cover opening unit disposed at the coupling part and configured to open a discharge cover of a dust bin of the cleaner, a dust collecting motor accommodated in the housing and configured to generate a suction force for suctioning dust in the dust bin of the cleaner, and a suction tube disposed in an upward-downward direction in the housing and connected to the coupling part. The cover opening unit includes a push protrusion that is configured to protrude along an axis of the housing and to face a coupling lever of the discharge cover, where the push protrusion is configured to press the coupling lever to thereby open the discharge cover based on the cleaner being coupled to the coupling part. The suction tube defines a bypass hole that has an elongated shape and that passes through at least a portion of the suction tube to thereby communicate with an inside of the suction tube and an outside of the suction tube, where the bypass hole is defined at a position configured to face the push protrusion in a direction in which the push protrusion presses the coupling lever.

Implementations according to this aspect can include one or more of the following features and the features described above. For instance, the cleaner station can further include a door coupled to the coupling part by a hinge and configured to open in a direction in which the discharge cover is opened to thereby allow an outside of the housing to communicate with the suction tube, and a door arm coupled to the door and configured to move the door. The dust collecting motor can be configured to, based on the door being closed, operate for a predetermined time to thereby generate the suction force in a state in which the dust bin is coupled to the coupling part.

In some implementations, the cover opening unit can include a protrusion support coupled to a lower end of the push protrusion and configured to linearly reciprocate together with the push protrusion. In some examples, the coupling part can include a first coupling part that has a shape corresponding to a shape of the dust bin and is configured to support a lower outer peripheral surface of the dust bin, and a second coupling part that is coupled to the first coupling part and includes a flat surface configured to support a lower surface of the protrusion support that linearly reciprocates with the push protrusion.

In some examples, the protrusion support can be configured to reciprocate in a first direction, where a size of the protrusion support in a second direction perpendicular to the first direction can be less than a size of the flat surface in the second direction. In some examples, the protrusion support can be configured to move along a movement axis that extends in the first direction through a center of the flat surface in the second direction.

According to another aspect, a cleaner station includes a housing configured to couple to a cleaner, a coupling part recessed from a surface of the housing toward an inside of the housing and configured to couple to at least a part of the cleaner, where the coupling part defines a dust passage hole at a position configured to face a dust bin of the cleaner based on the cleaner being coupled to the coupling part, a dust collecting motor accommodated in the housing and configured to generate a suction force for suctioning dust in the dust bin, and a suction tube disposed in an upward-downward direction in the housing and connected to the coupling part, where the suction tube is configured to communicate with the dust passage hole. The suction tube has a bypass hole having an elongated shape, where the bypass hole passes through at least a portion of the suction tube to thereby communicate with an inside of the suction tube and an outside of the suction tube. A cross-sectional area of the bypass hole is less than a cross-sectional area of the dust passage hole.

Implementations according to this aspect can include one or more of the following features and the features described above. For instance, the cleaner station can further include a cover opening unit disposed at the coupling part and configured to open a discharge cover of the dust bin. The cover opening unit can include a push protrusion configured to protrude along an axis of the housing and to face a coupling lever of the discharge cover, and the push protrusion can be configured to press the coupling lever to thereby open the discharge cover based on the cleaner being coupled to the coupling part. The bypass hole can be defined at a position configured to face the push protrusion in a direction in which the push protrusion presses the coupling lever.

In some implementations, the cleaner station can include a door coupled to the coupling part by a hinge and configured to open in a direction in which the discharge cover is opened to thereby allow an outside of the housing to communicate with the suction tube, and a door arm coupled to the door and configured to move the door. The dust collecting motor can be configured to operate for a predetermined time based on the door closing the dust passage hole to thereby supply a suction force to the bypass hole.

According to another aspect, a cleaner system includes a cleaner including a dust bin configured to receive dust and a cleaner station configured to couple to the cleaner and to remove the dust discharged from the dust bin. The dust bin includes a dust bin body that has a cylindrical shape and defines an opening at one side thereof, a discharge cover that is rotatably coupled to the dust bin body and configured to cover the opening and that includes a coupling hook configured to engage with the dust bin body, and a coupling lever coupled to the dust bin body and configured to move along an outer peripheral surface of the dust bin body in a longitudinal direction of the dust bin body to thereby release a hook engagement between the discharge cover and the dust bin body. The coupling lever includes a lever body that extends in the longitudinal direction of the dust bin body and an inclined lever portion that is connected to the lever body and extends in an inclined direction having a predetermined angle with respect to a movement direction of the coupling lever. The coupling lever defines a dust discharge groove that is recessed from an end of the inclined lever portion toward the lever body.

Implementations according to this aspect can include one or more of the following features and the features described above. For instance, the cleaner station can include a housing configured to couple to the cleaner, coupling part recessed from a surface of the housing toward an inside of the housing and configured to couple to at least a part of the cleaner, a suction tube disposed in an upward-downward direction in the housing and connected to the coupling part, and a push protrusion configured to protrude along an axis of the housing and to face the coupling lever, where the push protrusion is configured to press the coupling lever to thereby open the discharge cover based on the cleaner being coupled to the coupling part. The suction tube can define a bypass hole that has an elongated shape and that passes through at least a portion of the suction tube to thereby communicate with an inside of the suction tube and an outside of the suction tube. The bypass hole can be defined at a position configured to face the push protrusion in a direction in which the push protrusion presses the coupling lever.

In some implementations, an end of the suction tube can be connected to the coupling part, where a cross-sectional area of the end of the suction tube is greater than a cross-sectional area of the bypass hole. In some examples, the cleaner station can include a dust collecting motor accommodated in the housing and configured to generate a suction force for suctioning the dust in the dust bin, a door coupled to the coupling part by a hinge and configured to open in a direction in which the discharge cover is opened to thereby allow an outside of the housing to communicate with the suction tube, and a door arm coupled to the door and configured to move the door. The dust collecting motor can be configured to, based on the door being closed, operate for a predetermined time to thereby generate the suction force in a state in which the dust bin is coupled to the coupling part.

According to another aspect, a method is performed for removing residual dust in a cleaner system including a cleaner and a cleaner station that is configured to couple to the cleaner and to remove dust discharged from a dust bin of the cleaner. The method includes opening a door of the cleaner station to thereby allow an outside of the cleaner station and an inside of the cleaner station to communicate with each other, opening a discharge cover of the cleaner configured to open and close the dust bin, operating a dust collecting motor accommodated in the cleaner station to thereby suction the dust in the dust bin into the cleaner station, closing the door together with the discharge cover, and removing residual dust at a periphery of the dust bin based on the door being closed. Removing the residual dust includes operating the dust collecting motor for a predetermined time in a state in which the cleaner is coupled to the cleaner station to thereby suction the residual dust into the cleaner station.

Implementations according to this aspect can include one or more of the following features and the features described above. For instance, the cleaner station can include a housing configured to couple to the cleaner, a coupling part recessed from a surface of the housing toward an inside of the housing and configured to couple to at least a part of the cleaner, a suction tube disposed in an upward-downward direction in the housing and connected to the coupling part, and a push protrusion configured to protrude along an axis of the housing and to face a coupling lever of the discharge cover, where the push protrusion can be configured to push the coupling lever to thereby open the discharge cover based on the cleaner being coupled to the coupling part. The suction tube can define a bypass hole that has an elongated shape and that passes through at least a portion of the suction tube to thereby communicate with an inside of the suction tube and an outside of the suction tube, where the bypass hole is defined at a position configured to face the push protrusion in a direction in which the push protrusion presses the coupling lever. Removing the residual dust can include suctioning the residual dust into the suction tube through the bypass hole by operating the dust collecting motor.

In some implementations, the discharge cover can be configured to engage with a dust bin body of the dust bin, the dust bin body having a cylindrical shape. The coupling lever can include a lever body that extends in a longitudinal direction of the dust bin body, and an inclined lever portion that is connected to the lever body and extends in an inclined direction having a predetermined angle with respect to a movement direction of the coupling lever. The coupling lever can define a dust discharge groove that is recessed from an end of the inclined lever portion toward the lever body. Removing the residual dust can include suctioning the residual dust into the suction tube through the dust discharge groove and the bypass hole by operating the dust collecting motor.

In some implementations, the bypass hole can be provided separately from the main hole for suctioning the dust in the dust bin of the cleaner, which can help to suction the residual dust at one time during the process of suctioning the dust, thereby removing even the residual dust that can be accumulated on the coupling part of the cleaner station.

In some implementations, the dust in the dust bin of the cleaner can be suctioned first in the state in which both the main hole and the bypass hole are opened, and then the suction operation can be performed one more time to additionally suction the residual dust in the state in which the main hole is closed and only the bypass hole is opened. Therefore, the suction force of the dust collecting motor can be concentrated on the bypass hole at the time of additionally suctioning the residual dust, which can help to effectively remove the residual dust.

In some implementations, the residual dust accumulated inside the coupling lever disposed outside the dust bin of the cleaner can be effectively removed through the dust discharge groove formed in the coupling lever of the cleaner.

In some implementations, the dust collecting motor can operate again for a predetermined time in the residual dust removing step after the process of suctioning the dust in the dust bin is ended and the discharge cover is closed. Therefore, the suction force for suctioning the residual dust can be concentrated on the bypass hole and the dust discharge groove, which can help to more effectively remove the residual dust.

DETAILED DESCRIPTION

Hereinafter, exemplary implementations of the present disclosure will be described in detail with reference to the accompanying drawings.

Figure 1:
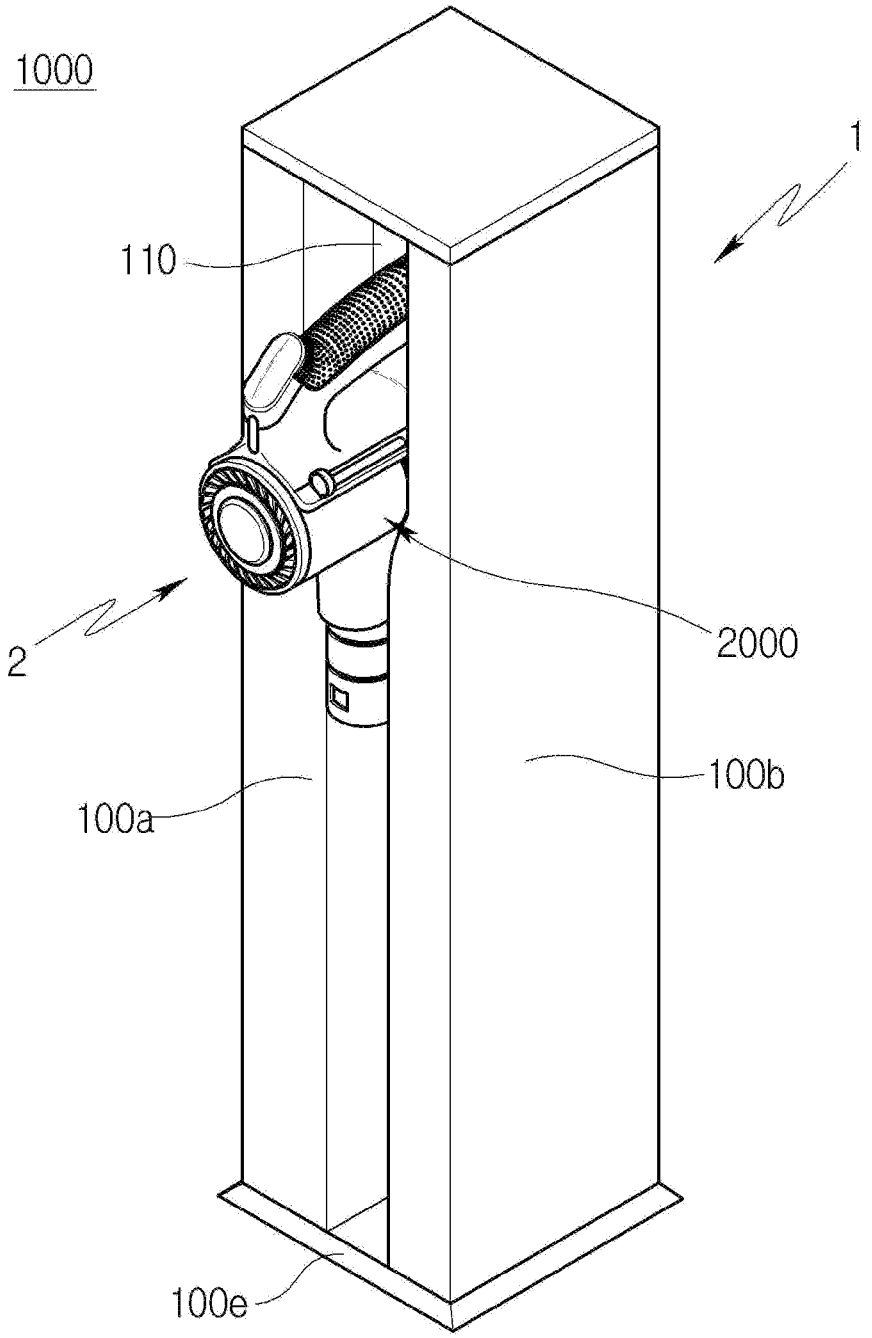
FIG. 1 is a perspective view illustrating an example of a cleaner system including a cleaner station and a cleaner.
Figure 2:
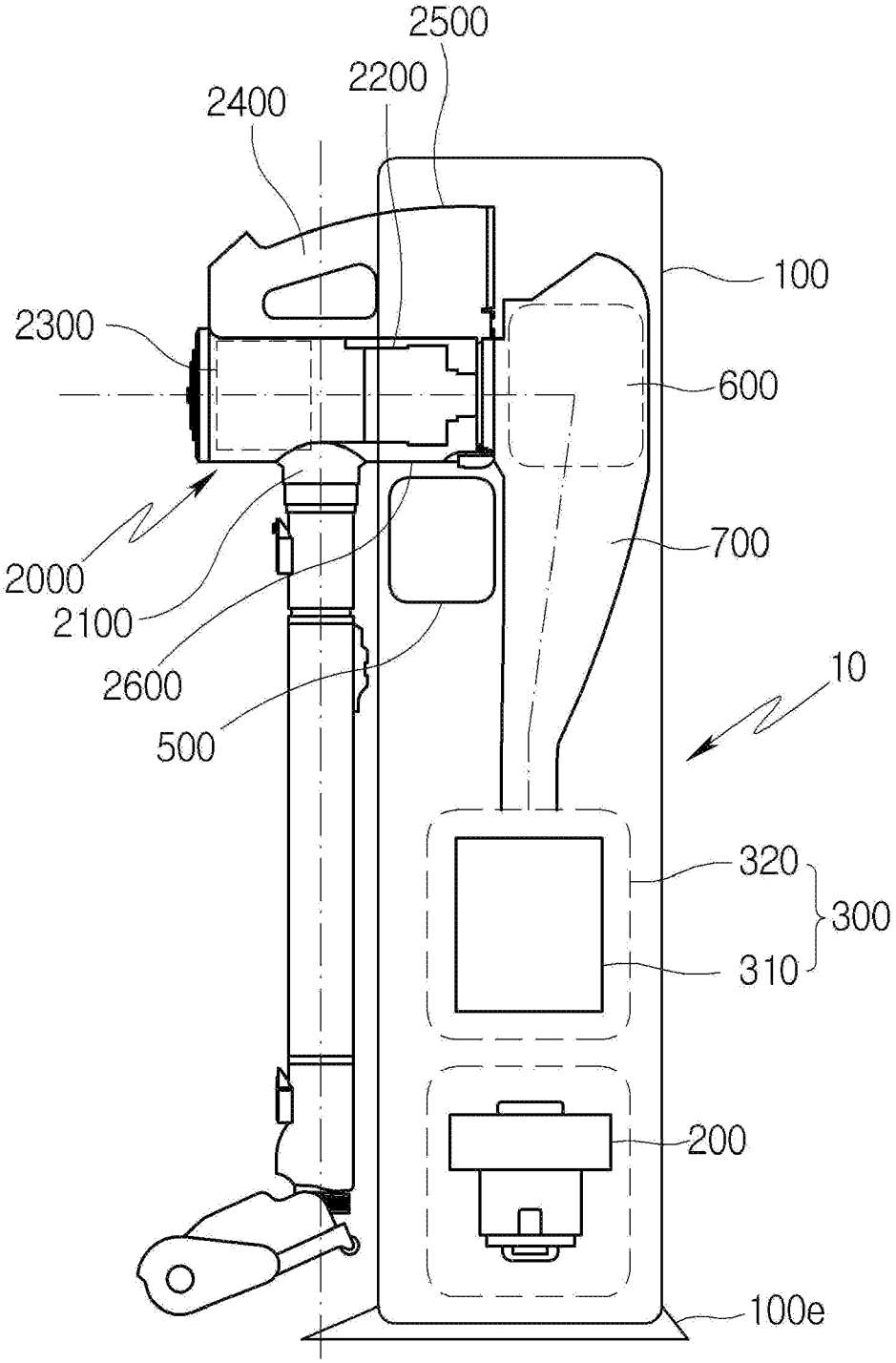
FIG. 2 is a view illustrating an example state in which the cleaner is coupled to the cleaner station and an example of an interior of the cleaner station at a lateral side of the cleaner station.
Figure 3:
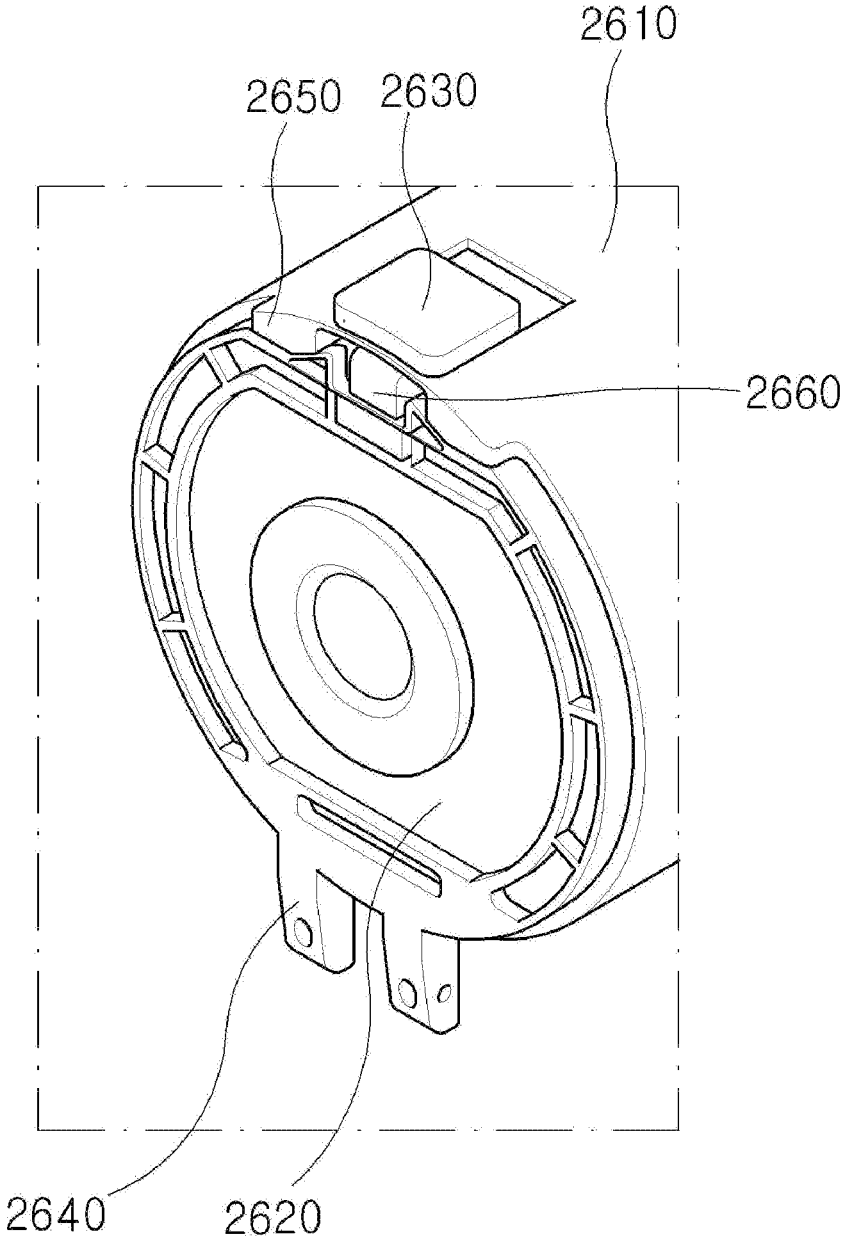
FIG. 3 is an enlarged view of an example structure for opening or closing a dust bin of the cleaner.
Figure 4:
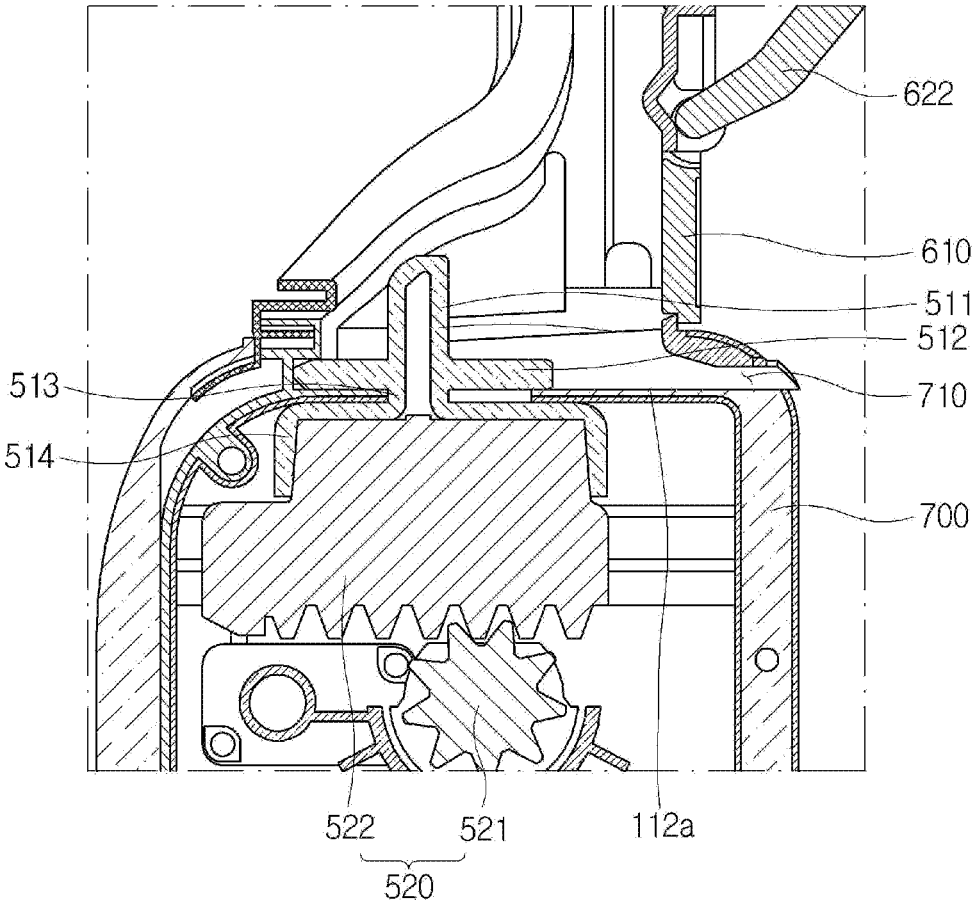
FIG. 4 is an enlarged view of an example of a cover opening unit of the cleaner station.
Figure 5:
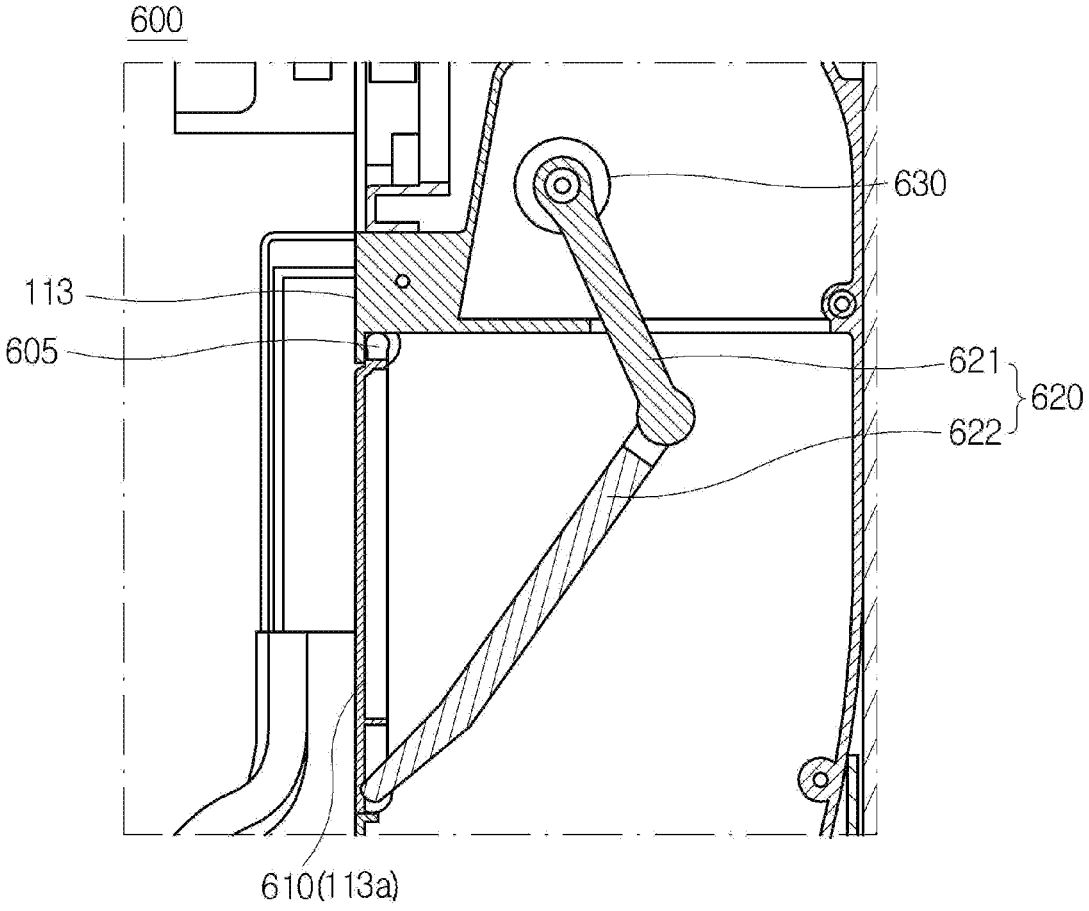
FIG. 5 is an enlarged view of an example of a door unit of the cleaner station.

FIG. 1 is a perspective view illustrating an example of a cleaner system 1000 including a cleaner station 1 and a cleaner 2, FIG. 2 is a view illustrating an example state in which the cleaner 2 is coupled to the cleaner station 1 and an example of an interior of the cleaner station 1 at a lateral side of the cleaner station 1, FIG. 3 is an enlarged view of an example structure for opening or closing a dust bin 2600 of the cleaner 2, FIG. 4 is an enlarged view of an example of a cover opening unit 500 of the cleaner station 1, and FIG. 5 is an enlarged view of an example of a door unit 600 of the cleaner station 1.

Referring to FIG. 1, the cleaner system 1000 can include the cleaner station 1 and the cleaner 2.

The cleaner station 1 is configured to be coupled to the cleaner 2 to remove dust discharged from the dust bin 2600 of the cleaner 2. The cleaner 2 can be coupled to a front side of the cleaner station 1. More specifically, a cleaner main body 2000 of the cleaner 2 can be coupled to the front side of the cleaner station 1.

In some implementations, the front side of the cleaner station 1 can be defined as a side in a direction in which a coupling part 110, which is made by recessing one surface of the housing 100 toward an interior of a housing 100 so that the main body of the cleaner 2 can be coupled to the coupling part 110, is directed. Further, a side, which is opposite to the front side of the housing 100 based on the coupling part 110, can be defined as a rear side. A structure of the housing 100 will be described below.

First, a configuration of the cleaner main body 2000 of the cleaner 2, which is configured to be coupled to the cleaner station 1, will be briefly described below.

Referring to FIG. 2, the cleaner main body 2000 can include a suction part 2100 configured to provide a flow path through which air containing dust can flow, a dust separating part 2200 configured to communicate with the suction part 2100 and separate the dust suctioned into the dust separating part 2200 through the suction part 2100, a suction motor 2300 configured to generate a suction force for suctioning the air, a handle 2400 configured to be grasped by a user, and a battery housing 2500 configured to accommodate a battery therein.

In addition, the cleaner main body 2000 can further include the dust bin 2600.

In some implementations, the dust bin 2600 can communicate with the dust separating part 2200 and trap the dust separated from the dust separating part 2200. The dust separating part 2200 can be configured to separate the dust in a cyclone dust collecting manner.

Referring to FIG. 3, the dust bin 2600 can include a dust bin body 2610, a discharge cover 2620, and a coupling lever 2630.

The dust bin body 2610 can have a cylindrical shape and be opened at one side thereof. The air introduced through the suction part 2100 passes through the dust separating part 2200 accommodated in the dust bin body 2610. In some cases, the dust may be trapped in the dust bin body 2610, and the air, from which the dust is separated, may flow toward the suction motor 2300 and be discharged to the outside of the cleaner 2. The dust bin body 2610 can have body projections 2650 disposed at two opposite sides with the coupling lever 2630 interposed therebetween, and the body projections 2650 are made by extending the dust bin body 2610 in a longitudinal direction.

The discharge cover 2620 can be rotatably coupled to one open side of the dust bin body 2610. More specifically, the discharge cover 2620 can be disposed at one open side of the dust bin body 2610 and coupled to the dust bin body 2610 by means of a dust bin hinge 2640. In some examples, the dust bin hinge 2640 can be disposed at one side close to the battery housing 2500. The discharge cover 2620 can rotate about the dust bin hinge 2640 to open or close the dust bin body 2610.

In addition, the discharge cover 2620 can include a coupling hook 2660 disposed at one side close to the suction part 2100 and configured to hook-engage with the dust bin body 2610. The coupling hook 2660 and the dust bin hinge 2640 can be disposed to be opposite to each other.

To release the hook engagement between the discharge cover 2620 and the dust bin body 2610, the coupling lever 2630 can move in a longitudinal direction of the dust bin body 2610 along an outer peripheral surface of the dust bin body 2610. The coupling lever 2630 can be disposed downward based on the state in which the cleaner 2 is coupled to the cleaner station 1. When an external force is applied to the coupling lever 2630 and thus the coupling lever 2630 moves in the longitudinal direction of the dust bin body 2610 (the direction in which the hook engagement is released), the coupling hook 2660 extending from the discharge cover 2620 is elastically deformed, such that the hook engagement between the discharge cover 2620 and the dust bin body 2610 can be released.

In some implementations, the coupling lever 2630 can be shaped to efficiently remove residual dust introduced into the inside of the coupling lever 2630 during the dust suction process of the cleaner station 1. A detailed configuration thereof will be described below. In some examples, the inside of the coupling lever 2630 can be or include a space defined between the coupling lever 2630 and the dust bin body 2610.

Next, the cleaner station 1 will be described.

Referring to FIG. 2, the cleaner station 1 can include the housing 100, a dust collecting motor 200, and a dust storage module 300.

The housing 100 is a component to which the cleaner 2 is coupled. The housing 100 can define an external appearance of the cleaner station 1. Specifically, the housing 100 can be provided in the form of a column including one or more outer wall surfaces. For example, the housing 100 can be formed in a shape similar to a quadrangular column.

The housing 100 has therein a space that can accommodate the dust collecting motor 200, the dust storage module 300, and the like.

The housing 100 can include a floor support part 100*e*. In some examples, the floor support part 100*e* can be disposed toward the floor. A bottom surface of the floor support part 100*e*, which is in contact with the floor, can be disposed in parallel with the floor. In some implementations, the bottom surface of the floor support part 100*e* can be disposed to be inclined with respect to the floor at a predetermined angle. The above-mentioned configuration can be advantageous in stably supporting the dust collecting motor 200 accommodated in the housing 100 and maintaining balance of an overall weight even in a case in which the cleaner 2 is coupled.

In addition, the floor support part 100*e* can be provided in the form of a plate extending from the bottom surface of the housing 100 to increase an area being in contact with the floor in order to prevent the cleaner station 1 from falling down and maintain the balance of the cleaner station 1.

In some examples, the housing 100 can include one or more outer wall surfaces, as described above. For example, the housing 100 can include a first outer wall surface 100*a* on which the coupling part 110 is provided. The housing 100 can further include a second outer wall surface 100*b*, a third outer wall surface 100*c*, and a fourth outer wall surface 100*d* sequentially disposed counterclockwise when viewed from the first outer wall surface 100*a*.

The coupling part 110 provided on the first outer wall surface 100*a* can be made by recessing one surface of the housing 100 toward the interior of the housing 100. More specifically, the coupling part 110 can be made as the first outer wall surface 100*a* is recessed to correspond to a shape of a part of the dust bin 2600 of the cleaner main body 2000. With this configuration, a part of the cleaner main body 2000 can be coupled to the cleaner station 1 and supported by the cleaner station 1.

In some examples, the housing 100 can be opened such that some of the components (e.g., the dust storage module 300) accommodated in the housing 100 are exposed.

The dust collecting motor 200 can be accommodated in the housing 100 and disposed below the dust storage module 300. The dust collecting motor 200 can provide a suction force to a suction tube 700 to be described below. Therefore, the dust collecting motor 200 can suction the dust in the dust bin body 2610 of the cleaner 2 (see FIG. 2).

Next, the dust storage module 300 is accommodated in the housing 100 and collects the dust suctioned from the dust bin 2600 of the cleaner 2 by the dust collecting motor 200. The dust storage module 300 can be detachably coupled to the housing 100.

Therefore, when the housing 100 is opened, the dust storage module 300 can be separated from the housing 100 and discarded, and a new dust storage module 300 can be coupled to the housing 100. That is, the dust storage module 300 can be defined as a consumable component.

The dust storage module 300 can include a dust bag 310. When the suction force is generated by the dust collecting motor 200, a volume of the dust bag 310 is increased, such that the dust can be accommodated in the dust bag 310. To this end, the dust bag 310 can be made of a material that transmits air but may not transmit foreign substances such as dust. For example, the dust bag 310 can be made of a non-woven fabric material and have a hexahedral shape when the dust bag 310 has an increased volume.

When a gas flow is formed by the suction force of the dust collecting motor 200, the air, which contains foreign substances and flows from the inside of the dust bin 2600 of the cleaner 2, moves into the dust bag 310 through the suction tube 700 and then moves out of the dust bag 310 while leaving the foreign substances in the dust bag 310.

In addition, the dust storage module 300 can further include a dust storage housing 320 accommodated in the housing 100 and having an internal space in which the dust bag 310 is coupled (see FIG. 2).

Hereinafter, the coupling part 110 to which the cleaner 2 is coupled will be described with reference to FIGS. 5 and 6.

Figure 6:
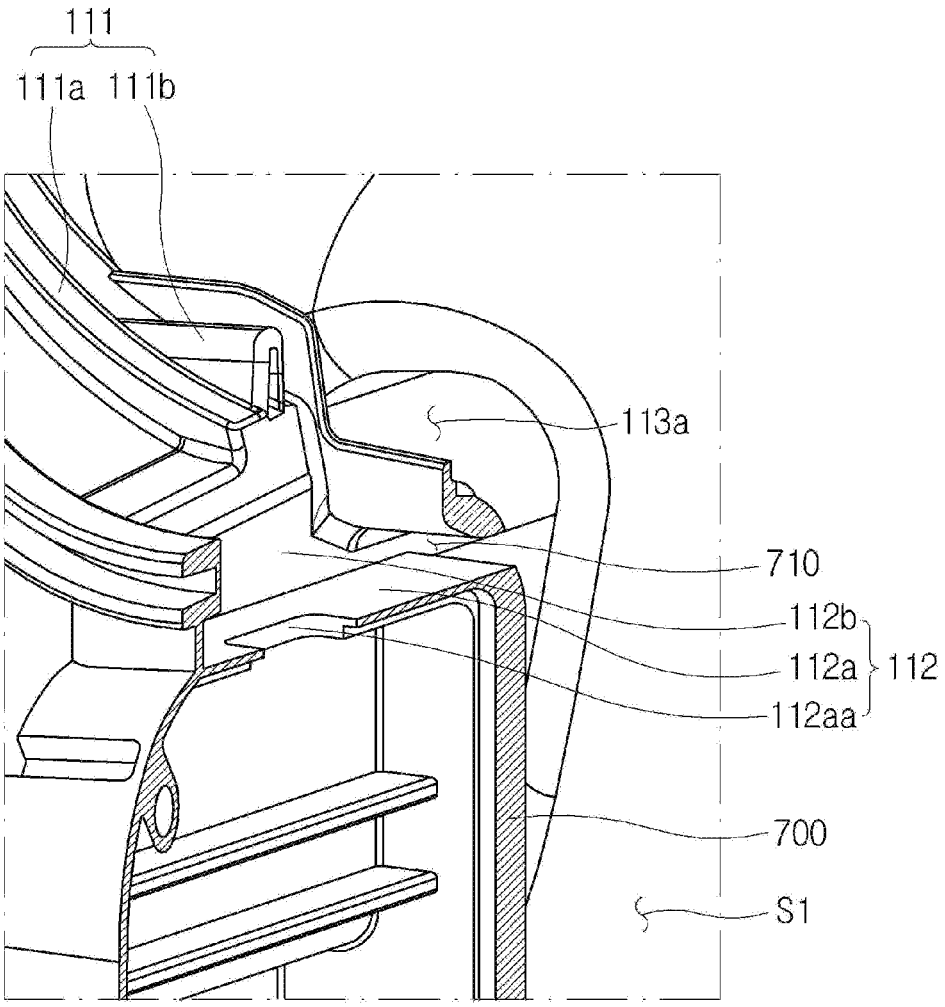
FIG. 6 is an enlarged perspective view illustrating an example of a cross-section of a coupling part and a cross-section of a suction tube.

FIG. 6 is an enlarged perspective view illustrating a cross-section of the coupling part 110 and a cross-section of the suction tube 700.

First, referring to FIG. 6, the coupling part 110 can include first coupling parts 111 and a second coupling part 112. In some examples, the first coupling parts 111 can correspond to the shape of the dust bin 2600 and support a part of a lower outer peripheral surface of the dust bin 2600. The second coupling part 112 can include a flat surface 112*a* coupled to the first coupling parts 111. A lower surface of a protrusion support 512 included in the cover opening unit 500 to be described below is disposed on the flat surface 112*a* and linearly reciprocates.

More specifically, the second coupling part 112 can provide a space that can extend downward from the first coupling parts 111 and accommodate a push protrusion 511. In some examples, the first coupling parts 111 can be disposed at left and right sides of the second coupling part 112 when viewed from the first outer wall surface 100*a*.

The first coupling parts 111 can each include a curved portion 111*a* and a protruding projection 111*b*. The curved portion 111*a* can be formed to correspond to the cylindrical shape of the dust bin body 2610 and support the dust bin body 2610. In addition, the protruding projection 111*b* is coupled to the curved portion 111*a* and made as the curved portion 111*a* extends and protrudes upward. The protruding projection 111*b* can be configured to support the body projection 2650 of the dust bin body 2610 and serve to fix the dust bin body 2610 and prevent the sway of the dust bin body 2610 when the dust bin 2600 is seated on the coupling part 110.

In some examples, the curved portions 111*a* and the protruding projections 111*b* can be symmetrically disposed at the left and right sides of the second coupling part 112 when viewed from the first outer wall surface 100*a*.

The second coupling part 112 can further include vertical walls 112*b* extending downward from the first coupling parts 111. The vertical walls 112*b* can be disposed at the left and right sides of the flat surface 112*a* when viewed from the first outer wall surface 100*a*. That is, the second coupling part 112 can include the flat surface 112*a* and the vertical walls 112*b* extending downward from ends of the first coupling parts 111, thereby defining the space in which the push protrusion 511 can rectilinearly reciprocate. In some examples, a protrusion neck insertion hole 112*aa* can be provided in the flat surface 112*a* of the second coupling part 112, and a protrusion neck 513 to be described below can be disposed in the protrusion neck insertion hole 112*aa*.

In some examples, the coupling part 110 can further include a third coupling part 113.

Referring to FIG. 5, the third coupling part 113 can be defined as a region disposed to face the discharge cover 2620 in the state in which the cleaner 2 is coupled to the cleaner station 1. The third coupling part 113 can include a charging part to which a battery is electrically connected to charge the cleaner 2, and a dust passage hole 113*a* disposed below the charging part and configured to allow the interior of the dust bin 2600 to communicate with the suction tube 700 of the cleaner station 1. A door hinge 605 can be coupled to the third coupling part 113 and disposed above the dust passage hole 113*a*. A door 610 can be disposed in the dust passage hole 113*a* and coupled to the door hinge 605 to open or close the dust passage hole 113*a*. The dust passage hole 113*a* can be a hole having a diameter corresponding to a diameter of the dust bin 2600 and disposed at a position that faces the bottom surface of the dust bin 2600 of the cleaner 10 when the cleaner 2 is coupled to the coupling part 110. Therefore, the dust passage hole 113*a* can serve as a main hole through which the dust in the dust bin 2600 is suctioned into an inner flow path of the cleaner station 1.

Next, a configuration in which the cleaner station 1 and the cleaner 2 are coupled to each other will be described with reference to FIG. 2 again.

As described above, the cleaner 2 can be coupled to the front side of the housing 100. More specifically, some components of the main body 2100 of the cleaner 2 are coupled to the coupling part 110, such that the entire cleaner 2 can be mounted on the cleaner station 1. More specifically, when the cleaner 2 is coupled to the coupling part 110 of the housing 100, a longitudinal axis of the dust bin 2600 can be disposed in parallel with the ground surface. In addition, when the cleaner 2 is coupled to the coupling part 110 of the housing 100, the longitudinal axis of the dust bin 2600 can be disposed to be perpendicular to a major axis of the housing 100. In some examples, the cleaner 2 can be mounted so that a longitudinal axis of the suction part 2100 of the cleaner 2 is disposed in parallel with the major axis of the housing 100.

In some examples, as described below, the suction tube 700 of the cleaner station 1 can extend in an upward/downward direction in the housing 100. Therefore, the dust existing in the dust bin 2600 is moved in a horizontal direction along the dust bin body 2610 and then introduced into the suction tube 700 by the suction force of the dust collecting motor 200. The flow direction of the dust is changed to a vertical direction, such that the dust is collected in the dust storage module 300 accommodated in an inner lower side of the housing 100.

That is, the dust in the dust bin 2600 of the cleaner 2 can be collected in the dust storage module 300 of the cleaner station 1 by the suction force of the dust collecting motor 200 and the gravity.

With this configuration, it can be possible to remove the dust in the dust bin without the user's separate manipulation, thereby providing convenience for the user. In addition, it can be possible to eliminate the inconvenience caused because the user needs to empty the dust bin all the time. In addition, it can be possible to prevent or reduce the dust from scattering when emptying the dust bin.

The cleaner station 1 can further include the cover opening unit 500.

The cover opening unit 500 can be configured to open the discharge cover 2620 of the cleaner 2. Referring to FIG. 4, the cover opening unit 500 can include the push protrusion 511, cover opening gears 520, and a cover opening motor.

When the cleaner 2 is coupled to the coupling part 110, the push protrusion 511 can linearly reciprocate on the coupling part 110 to press and open the discharge cover 2620. More specifically, the push protrusion 511 can be disposed at a position at which the push protrusion 511 can be disposed on the coupling part 110 and press the coupling lever 2630. The push protrusion 511 can linearly reciprocate to press the coupling lever 2630. More specifically, the push protrusion 511 can protrude upward in the direction of the major axis of the housing and be disposed at a position facing the coupling lever 2630 provided to open the discharge cover 2620 of the cleaner 2.

The cover opening unit 500 can further include the protrusion support 512, the protrusion neck 513, and a gear coupling block 514.

In some examples, the protrusion support 512 is coupled to a lower end of the push protrusion 511 and configured to linearly reciprocate together with the push protrusion 511. A lower surface of the protrusion support 512 can be disposed to face the flat surface 112*a* of the second coupling part 112, such that the protrusion support 512 can linearly reciprocate on the flat surface 112*a*.

The protrusion neck 513 can be coupled to the lower surface of the protrusion support 512 and disposed in the protrusion neck insertion hole 112*aa*. The protrusion neck 513 can be coupled between the protrusion support 512 and the gear coupling block 514. That is, the protrusion support 512 can be coupled to an upper portion of the protrusion neck 513, the gear coupling block 514 can be coupled to a lower portion of the protrusion neck 513, the push protrusion 511 and the protrusion support 512 can be exposed to an upper side of the flat surface 112*a*, and the gear coupling block 514 can be disposed at a lower side of the flat surface 112*a*. The protrusion neck 513 can have a smaller width than the protrusion support 512 and the gear coupling block 514.

The gear coupling block 514 can be disposed at the lower side of the flat surface 112*a* and linearly reciprocated by a movement of the cover opening gear 520.

The cover opening motor can provide the cover opening gears 520 with power for rectilinearly and reciprocatingly moving the push protrusion 511. For instance, the cover opening gears 520 can be coupled to the cover opening motor and move the push protrusion 511, the protrusion support 512, the protrusion neck 513, and the gear coupling block 514 using the power of the cover opening motor. The cover opening gears 520 can include a first cover opening gear 521 configured to receive rotational power from a shaft of the cover opening motor, and a second cover opening gear 522 configured to engage with the first cover opening gear 521 and transmit the rectilinear and reciprocating movement to the push protrusion 511.

In some examples, the first cover opening gear 521 can be a pinion gear, and the second cover opening gear 522 can be a rack gear.

In other words, when the main body of the cleaner 2 is fixed to the coupling part 110, the cover opening motor can move the push protrusion 511 by means of the cover opening gears 520, open the discharge cover 2620, and separate the discharge cover 2620 from the dust bin body 2610.

The cleaner station 1 can further include the door unit 600.

Referring to FIG. 5, the door unit 600 can include the door 610, a door arm 620, and a door motor 630.

The door 610 can be hinge-coupled to the coupling part 110 and opened in a direction in which the discharge cover 2620 is opened, thereby allowing the suction tube 700 to communicate with the outside of the housing 100. More specifically, the door 610 can be coupled to the door hinge 605 disposed on the third coupling part 113. The door 610 can rotate about the door hinge 605.

When the door arm 620 pulls the door 610 in a state in which the door 610 blocks the dust passage hole 113*a* and closes a portion between the inside and outside of the housing 100, the door 610 can rotate toward the inside of the housing 100 of the cleaner station 1. In some examples, when the door arm 620 pushes the door 610, the door 610 can rotate toward the outside of the cleaner station 1.

The door motor 630 can provide the door arm 620 with power for rotating the door 610. Specifically, the door motor 630 can rotate the door arm 620 in a forward or reverse direction. In some examples, the forward direction can refer to a direction in which the door arm 620 pulls the door 610 toward the inside of the housing 100. In addition, the reverse direction can refer to a direction in which the door arm 620 pushes the door 610 toward the outside of the housing 100.

The door arm 620 is coupled to the door 610 and configured to open or close the door 610. The door arm 620 serves to connect the door 610 and the door motor 630. The door arm 620 can open or close the door 610 using power generated by the door motor 630.

For example, the door arm 620 can include a first door arm 621 and a second door arm 622. One end of the first door arm 621 can be coupled to the door motor 630. The first door arm 621 can be rotated by the power of the door motor 630. The other end of the first door arm 621 can be rotatably coupled to the second door arm 622. The first door arm 621 can transmit a force transmitted from the door motor 630 to the second door arm 622. One end of the second door arm 622 can be coupled to the first door arm 621. The other end of the second door arm 622 can be coupled to the door 610. The second door arm 622 can push or pull the door 610.

An arrangement of a bypass hole 710 formed in the suction tube 700 and a specific structure for removing residual dust, which is a technical solution according to the present disclosure, will be described below with reference to FIGS. 4 and 6.

The cleaner station 1 can further include the suction tube 700.

First, referring to FIG. 6, the suction tube 700 can be accommodated in the housing 100 and disposed in the upward/downward direction. The suction tube 700 can provide a space 51 in which the air containing the dust discharged from the dust bin 2600 of the cleaner 2 can flow. That is, when the cleaner 2 is coupled to the cleaner station 1, the dust bin 2600 can be disposed at an upper open end of the suction tube 700. In some examples, because a lower open end of the suction tube 700 is coupled to the dust storage module 300, the dust in the dust bin body 2610 can be trapped in the dust storage module 300 through the suction tube 700 when the discharge cover 2620 is separated from the dust bin body 2610.

In addition, the upper open end of the suction tube 700 can be defined as the dust passage hole 113*a*. As described above, the dust passage hole 113*a* can serve as a main hole through which the dust in the dust bin 2600 is suctioned into the housing 100.

The suction tube 700 can have the bypass hole 710 for removing the residual dust. In some examples, referring to FIG. 4, the bypass hole 710 is disposed at a position that faces the push protrusion 511 in a direction in which the push protrusion 511 disposed on the suction tube 700 presses the coupling lever 2630 coupled to the dust bin body 2610. The bypass hole 710 can allow the inside and outside of the suction tube 700 to communicate with each other. For example, the bypass hole 710 can be provided in the form of a long hole having an elongated shape in the horizontal direction. More specifically, the bypass hole 710 can penetrate the suction tube 700 and be disposed at the same level as the flat surface 112*a* on which the protrusion support 512 linearly reciprocates.

The bypass hole 710 can be formed below the dust passage hole 113*a*. In addition, the bypass hole 710 can have a cross-sectional area smaller than a cross-sectional penetration area of the dust passage hole 113*a*.

With this configuration, when the dust collecting motor 200 generates a suction force in the state in which the dust passage hole 113*a* is closed, a high suction force can be applied and concentrated onto the small cross-sectional area of the bypass hole 710, thereby effectively removing the residual dust.

In addition, with this configuration, the residual dust, which is dropped and accumulated at the periphery of the push protrusion 511 in the cleaner station 1 when the discharge cover 2620 of the dust bin 2600 is opened, can be suctioned into the suction tube 700 through the bypass hole 710 by the suction force of the dust collecting motor 200. That is, a route through which the dust is suctioned into the suction tube 700 through the dust bin 2600 and the dust passage hole 113*a* can be referred to as a main suction route, and a route through which the residual dust dropped from the dust bin 2600 is suctioned into the suction tube 700 from the periphery of the push protrusion 511 (the periphery of the second coupling part 112) through the bypass hole 710 can be referred to as a bypass suction route. The cleaner station 1 can remove the dust, which is likely to be accumulated in a space at the periphery of the push protrusion in the cleaner station, through the bypass suction route. Therefore, it can be possible to hygienically manage the cleaner station and reduce the risk that the interior of the cleaner station is contaminated.

An operation of the dust collecting motor 200 for removing the residual dust through the bypass suction route will be described below.

The dust collecting motor 200 can operate for a first time t1 when the cleaner 2 is coupled to the coupling part 110, the door unit 600 opens the door 610, the cover opening unit 500 opens the discharge cover 2620, and the interior of the dust bin body 2610 communicates with the suction tube 700. In some examples, the air containing the dust passes through the main suction route and the bypass suction route and flows into the internal space Si of the suction tube 700, such that the dust can be trapped in the dust bag 310 coupled to the lower end of the suction tube 700.

When the operation of the dust collecting motor 200 is stopped after the first time t1 elapses, the door unit 600 can close the door 610. When the door arm 620 pushes the door 610 in the direction in which the door 610 is closed, the discharge cover 2620 can also move together with the door 610 in the direction in which the dust bin 2600 is closed. Therefore, the discharge cover 2620 is coupled to the dust bin body 2610 again, and the door 610 also closes the dust passage hole 113*a*.

In the state in which the dust bin 2600 is still coupled to the coupling part 110 after the door 610 is closed by the door unit 600, the dust collecting motor 200 can operate again for a second time t2 to generate the suction force. In some examples, since the main suction route is in the closed state, the air containing the dust flows into the internal space Si of the suction tube 700 by passing only through the bypass suction route. In some examples, when the dust collecting motor 200 generates a constant suction force, the suction force of the dust collecting motor 200 can be more greatly concentrated on the bypass suction route in comparison with the case in which the dust collecting motor 200 operates in the state in which the door 610 is opened.

The suction force of the dust collecting motor 200 can be concentrated on the bypass suction route, and thus the suction force applied to the residual dust can increase. That is, since the dust collecting motor 200 operates again in the state in which the discharge cover 2620 and the door 610 are closed, it can be possible to improve the efficiency in removing the residual dust.

Further, the dust can also fly and be attached to the inner side of the door 610 (a side opposite to the side facing the discharge cover 2620) when the dust is suctioned by the dust collecting motor 200 in the state in which the discharge cover 2620 and the door 610 are opened. The dust attached to the inner side of the door 610 can also be removed as the dust collecting motor 200 operates again in the state in which the door 610 is closed.

In some examples, the first time t1 and the second time t2 can be preset by a control unit of the cleaner station 1. In some examples, the first time t1 for which a large amount of dust needs to be suctioned can be equal to or longer than the second time t2 for which the residual dust is suctioned. The control unit can be accommodated in the housing 100 and control the operation, the stopping operation, and the suction force of the dust collecting motor 200.

Figure 7:
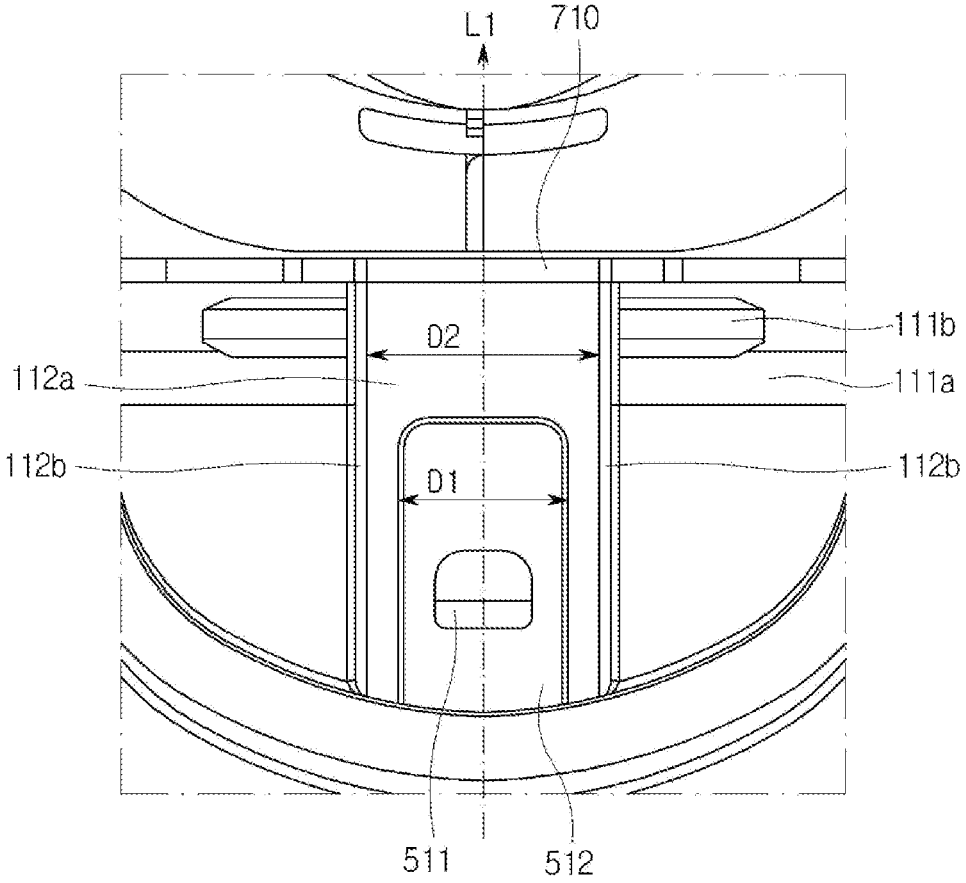
FIG. 7 is a view illustrating the coupling part when viewed from above.
Figure 8:
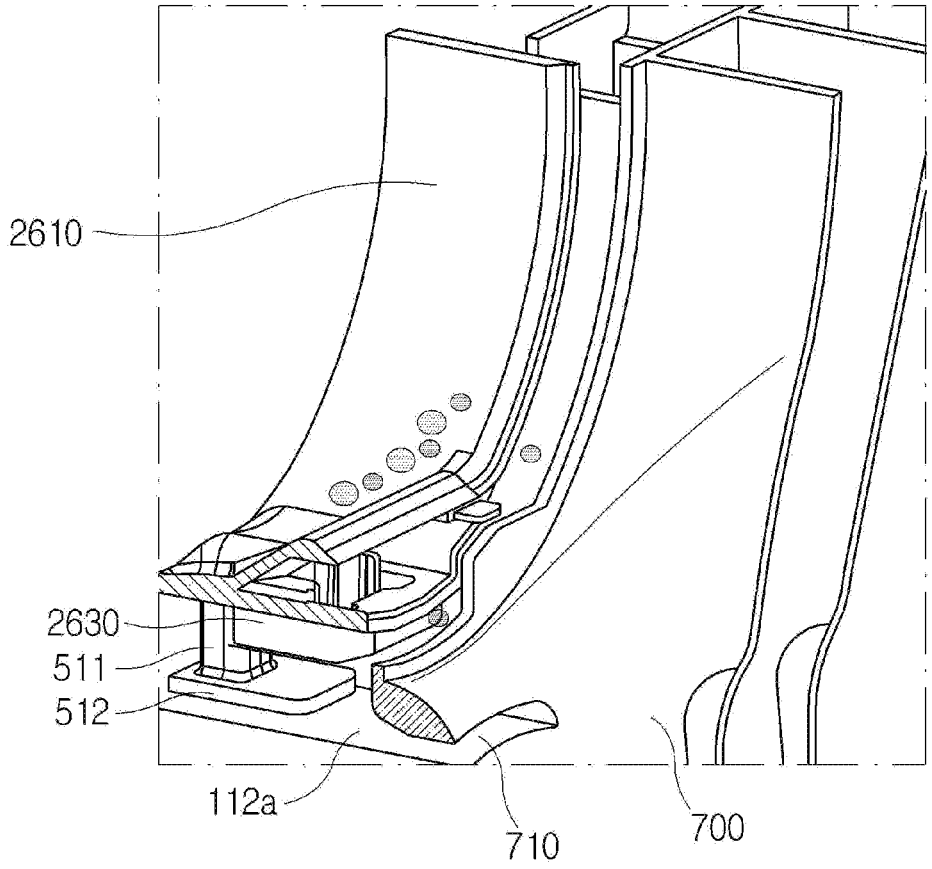
FIG. 8 is a cross-sectional view illustrating an example state in which the cleaner is coupled to the coupling part.

FIG. 7 is a view illustrating the coupling part 110 when viewed from above, and FIG. 8 is a cross-sectional view illustrating the state in which the cleaner 2 is coupled to the coupling part 110.

Referring to FIGS. 7 and 8, a direction in which the protrusion support 512 linearly reciprocates is referred to as a first direction, and a direction perpendicular to the first direction is referred to as a second direction. A size D1 of the protrusion support 512 in the second direction can be smaller than a size D2 of the flat surface 112*a* in the second direction. In other words, the ends of the protrusion support 512 disposed in the second direction can be spaced apart from the vertical walls 112*b* of the second coupling part 112 at a predetermined distance.

The foreign substances, which flow to the second coupling part 112 of the cleaner station 1, tend to be accumulated in a random shape, and the foreign substances can be mostly removed through the bypass hole 710 formed in the suction tube 700. However, if the size D1 in the second direction of the protrusion support 512 is almost equal to the size D2 in the second direction of the flat surface 112*a* of the second coupling part 112, i.e., if the ends of the protrusion support 512 disposed in the second direction are in contact with or disposed to be too close to the vertical walls 112*b* of the second coupling part 112, there is an increasing likelihood that the accumulated foreign substances may not be discharged through the bypass hole 710.

In some cases, if hard and small foreign substances such as sand grains are accumulated in small gaps between the ends of the protrusion support 512 and the vertical walls 112*b*, the resistance can occur against the rectilinear and reciprocating movement, and rustling noise can occur due to friction between the protrusion support 512 and the foreign substances. In this regard, the cleaner station 1 can be configured such that the ends of the protrusion support 512 are spaced apart from the vertical walls 112*b* at a predetermined distance. In some examples, the predetermined spacing distance can be set in consideration of sizes of foreign substances which are likely to flow to the second coupling part 112 by being dropped by the gravity and discharged through a gap between the dust bin body 2610 and the coupling part 110 when the discharge cover 2620 is opened (see FIG. 8).

The present disclosure may help prevent or reduce the accumulation of foreign substances, the occurrence of resistance against the rectilinear and reciprocating movement, the occurrence of noise, etc.

In some implementations, referring back to FIG. 7, a movement axis L1 of the movement direction in which the protrusion support 512 linearly reciprocates can be disposed at a center in the second direction of the flat surface 112*a*. In other words, a distance between the left end of the protrusion support 512 and the vertical wall 112*b* close to the left end of the protrusion support 512 can be equal to a distance between the right end of the protrusion support 512 and the vertical wall 112*b* close to the right end of the protrusion support 512. That is, the second coupling part 112 and the protrusion support 512 can be symmetric with respect to the movement axis L1 of the protrusion support 512. With this configuration, the left and right spacing distances between the protrusion support 512 and the vertical walls 112*b* can be equally set as minimum distances based on the movement axis L1 of the protrusion support 512, and the internal space of the cleaner station 1 can be efficiently designed.

A structure of the coupling lever 2630 of the cleaner 2 will be described in detail below.

Figure 9:
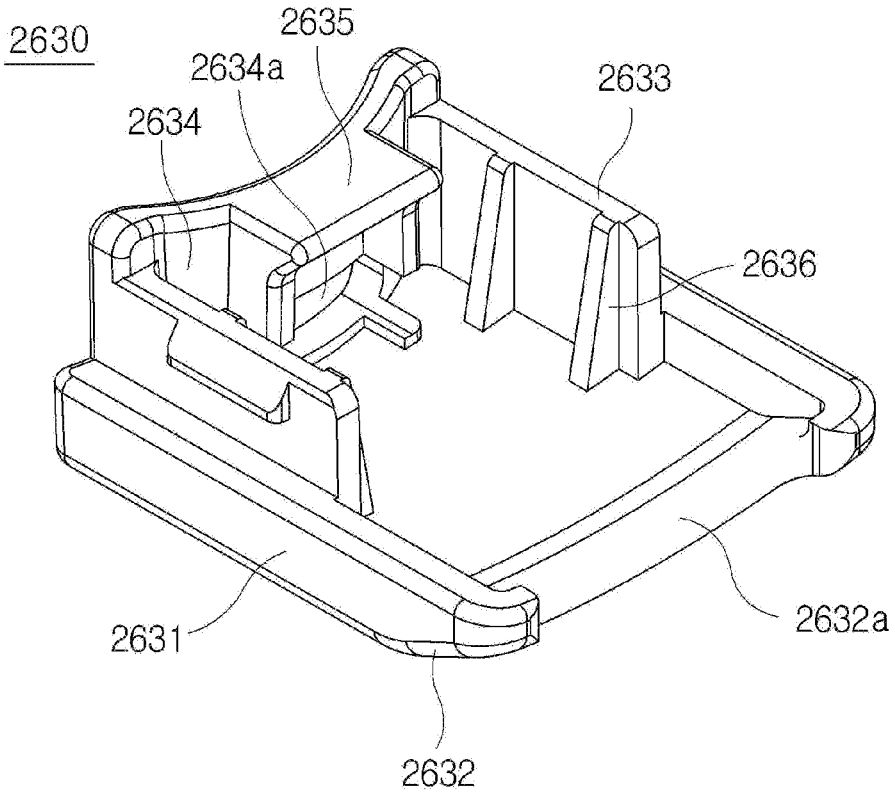
FIG. 9 is a perspective view of an example of a coupling lever of the cleaner.
Figure 10:
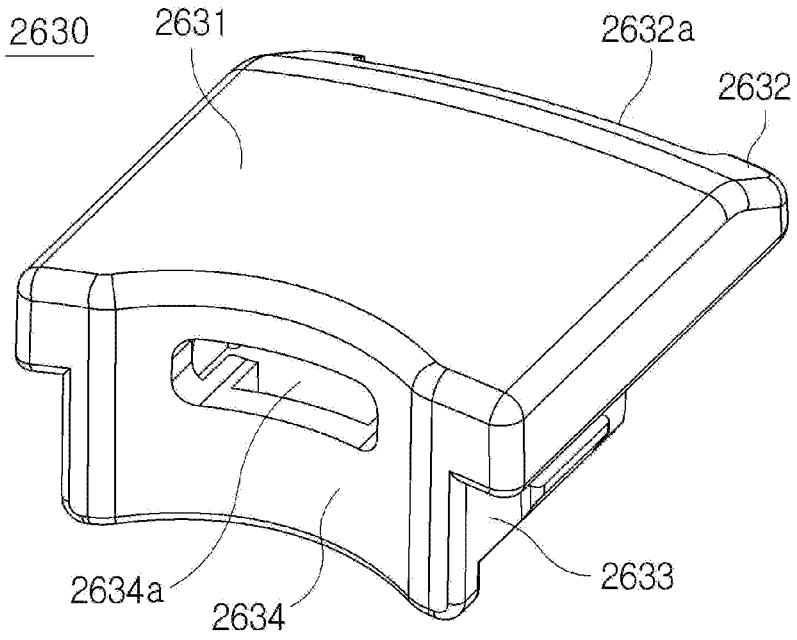
FIG. 10 is a perspective view of the coupling lever in FIG. 9 when viewed in another direction.
Figure 11:
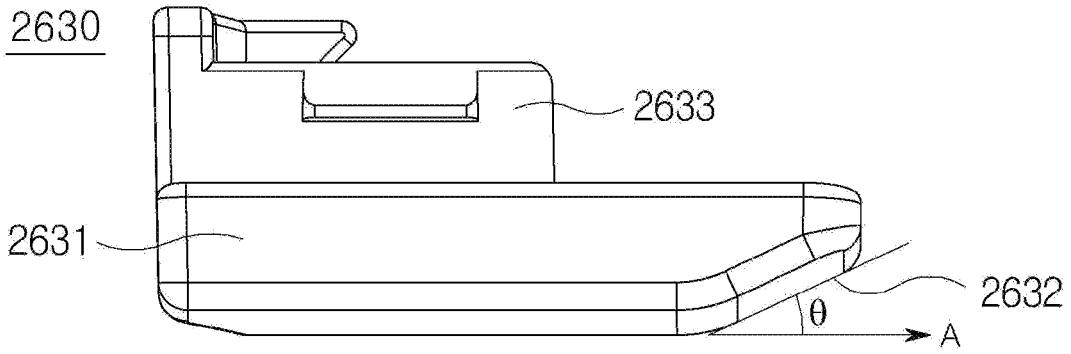
FIG. 11 is a side view of the coupling lever in FIG. 9.
Figure 12:
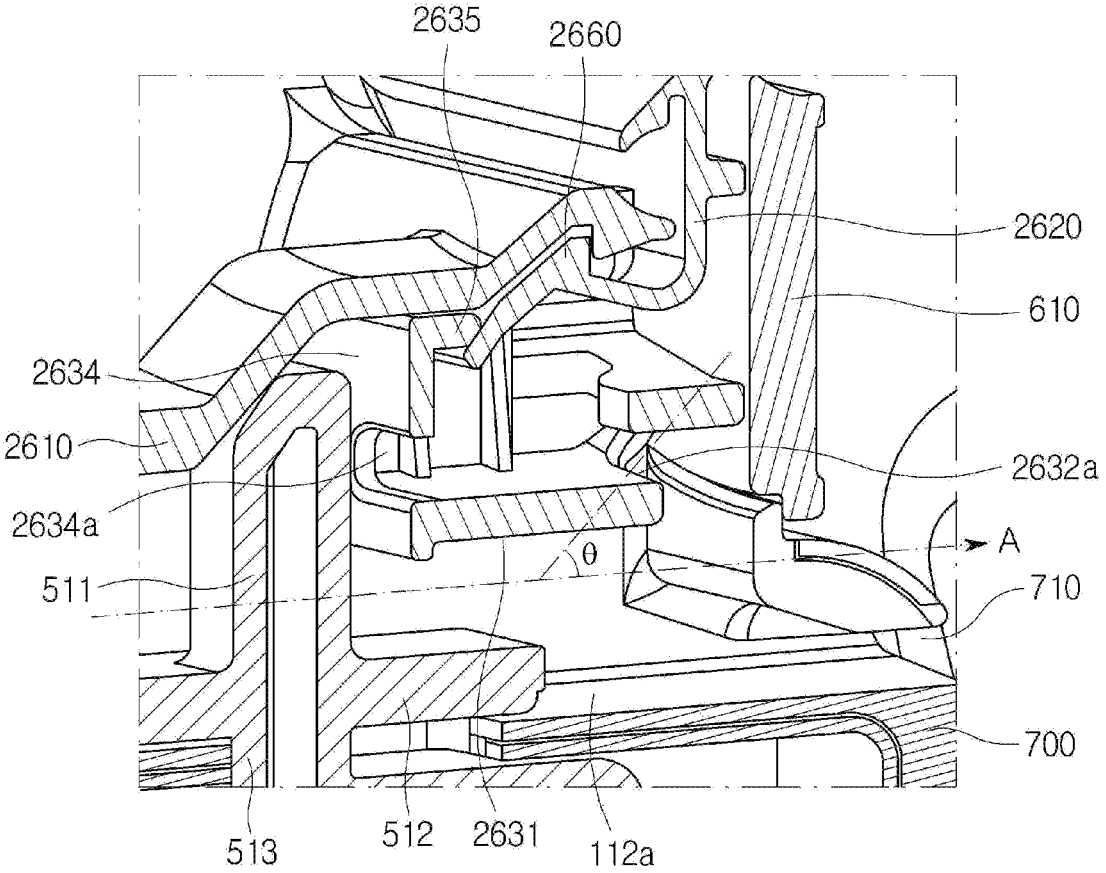
FIG. 12 is a perspective view illustrating an example relationship between a direction in which an inclined lever portion of the coupling lever is disposed and a movement direction of a push protrusion.

FIG. 9 is a perspective view of the coupling lever 2630 of the cleaner 2, FIG. 10 is a perspective view illustrating the coupling lever 2630 in FIG. 9 when viewed in another direction, FIG. 11 is a side view of the coupling lever 2630 in FIG. 9, and FIG. 12 is a perspective view illustrating a relationship between a movement direction A of the push protrusion 511 and a direction in which an inclined lever portion 2632 of the coupling lever 2630 is formed.

Referring to FIGS. 9 to 12, the coupling lever 2630 can include a lever body 2631, the inclined lever portion 2632, lever sidewalls 2633, a lever pressing portion 2634, and a hook pressing portion 2635.

The lever body 2631 can define a part of an external shape of the coupling lever 2630. The lever body 2631 can extend in the longitudinal direction of the dust bin body 2610. In some examples, the lever body 2631 can be bent by a predetermined length toward the center of the dust bin body 2610 from two opposite ends thereof in a direction perpendicular to the direction in which the lever body 2631 extends, thereby defining an internal space inside the coupling lever 2630. In addition, one end of the lever body 2631 in the direction in which the lever body 2631 extends can be connected to the inclined lever portion 2632.

The inclined lever portion 2632 can be connected to the lever body 2631 at one end of the extending lever body 2631 and extend from the lever body 2631.

In some implementations, the inclined lever portion 2632 can have a dust discharge groove 2632*a* made by recessing the inclined lever portion 2632. Since the dust discharge groove 2632*a* is provided in the coupling lever 2630, the residual dust, which flows into the coupling lever 2630, can pass through the dust discharge groove 2632*a* by the suction operation of the dust collecting motor 200 and be introduced into the suction tube 700 and then removed.

The inclined lever portion 2632 can be inclined toward the center of the dust bin body 2610 based on the state in which the coupling lever 2630 is coupled to the dust bin body 2610. In other words, the inclined lever portion 2632 can extend from the lever body 2631 and be inclined upward at a predetermined angle θ with respect to the movement direction A of the coupling lever 2630. When the cleaner 2 is coupled to the coupling part 110, the inclined lever portion 2632 can be disposed obliquely with respect to the door 610. In other words, when the cleaner 2 is coupled to the coupling part 110, the inclined lever portion 2632 can be disposed toward the bypass hole 710. With this configuration, the dust discharge groove 2632*a* through which the residual dust needs to be discharged may not be blocked by the door 610, and the residual dust can be smoothly removed through the bypass hole 710 via the dust discharge groove 2632*a* (see FIGS. 11 and 12).

The lever sidewalls 2633 are coupled to the lever body 2631 and the lever pressing portion 2632. One or more sidewall support ribs 2637 disposed toward the inside of the coupling lever 2630 can be respectively coupled to the lever sidewalls 2633.

The lever pressing portion 2634 can be coupled to the other end of the lever body 2631. In some examples, the other end of the lever body 2631 can be oriented to a direction opposite to the direction in which the inclined lever portion 2632 is disposed. The lever pressing portion 2634 can extend from the other end of the lever body 2631 in a direction perpendicular to the direction in which the lever body 2631 extends. An external force is applied to the lever pressing portion 2634 by a user. When the external force is applied to the lever pressing portion 2634, the coupling lever 2630 moves in the longitudinal direction of the dust bin 2600 and opens the discharge cover 2620.

The lever pressing portion 2634 can have a lever hole 2634*a* that penetrates the lever pressing portion 2634. The lever hole 2634*a* can be provided in the form of a long hole that penetrates the lever pressing portion 2634 and is elongated in the direction in which the lever sidewall 2633 is disposed. In addition, the lever hole 2634*a* and the dust discharge groove 2632*a* can be disposed to face each other.

A gas flow, which communicates with the bypass hole 710 through the dust discharge groove 2632*a* via the lever hole 2634*a* from the outside of the coupling lever 2630, can be formed by the lever hole 2634*a* and the dust discharge groove 2632*a* disposed to face each other when the dust collecting motor 200 generates the suction force. Therefore, the gas flow may not be blocked by the lever pressing portion 2634 during the suction operation of the dust collecting motor 200, which can help to further improve the effect of suctioning the residual dust.

The hook pressing portion 2635 can be coupled to the lever pressing portion 2634. One side of the lever pressing portion 2634 can be coupled to the lever body 2631, and the other side of the lever pressing portion 2634 can be coupled to the hook pressing portion 2635. In some examples, the hook pressing portion 2635 can extend in the same direction as the lever body 2631. The hook pressing portion 2635 can elastically deform the coupling hook 2660 by pressing the coupling hook 2660 of the discharge cover 2620. In other words, when the external force is applied to the lever pressing portion 2634 by the user, the hook pressing portion 2635 can press the coupling hook 2660, and the discharge cover 2620 can be opened (see FIG. 12).

Figure 13:
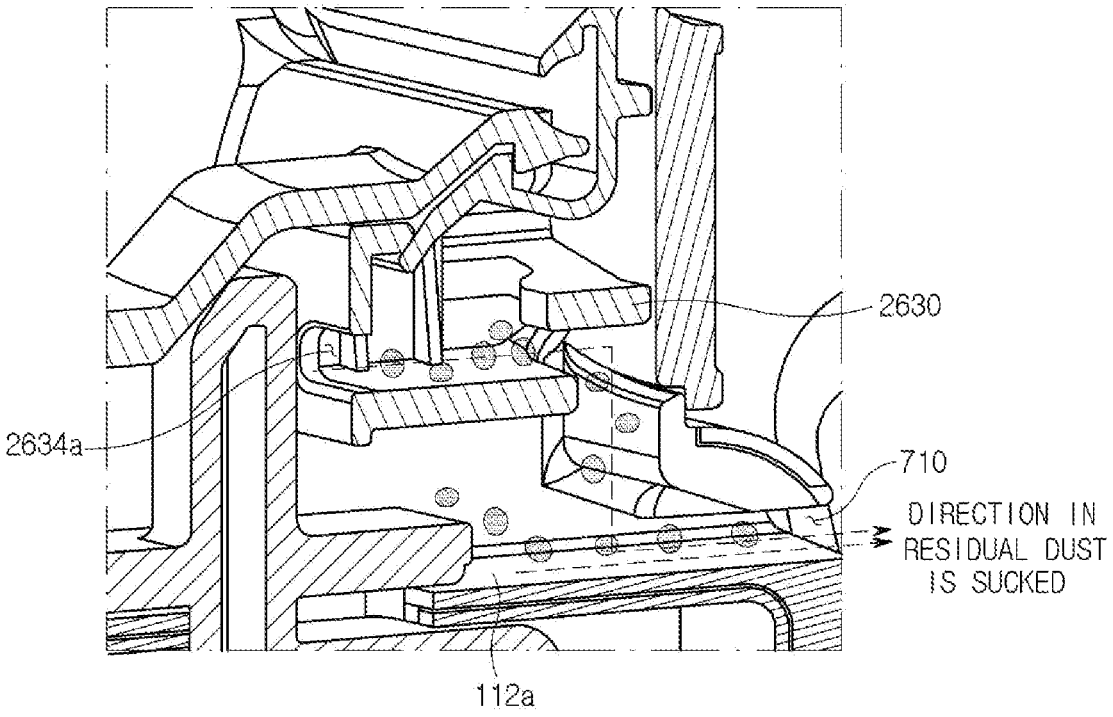
FIG. 13 is a schematic view illustrating an example of a suction route of residual dust through a bypass hole and a dust removing groove of the coupling lever.

FIG. 13 is a schematic view illustrating an example of a suction route of the residual dust through the bypass hole 710 and the dust discharge groove 2632*a* of the coupling lever 2630.

Referring to FIGS. 12 and 13, the residual dust, which flows into the second coupling part 112 during the process of opening the discharge cover 2620 or the process of suctioning the dust into the cleaner station 1, can be suctioned into the suction tube 700 through the bypass hole 710 from the second coupling part 112. In addition, the residual dust, which flows into the coupling lever 2630 (the space between the coupling lever 2630 and the dust bin body 2610) during the process of opening the discharge cover 2620 or the process of suctioning the dust into the cleaner station 1, can be suctioned into the suction tube 700 through the bypass hole 710 from the dust discharge groove 2632*a*.

Next, a method of removing residual dust using the cleaner system 1000 will be described with reference to FIG. 14.

Figure 14:
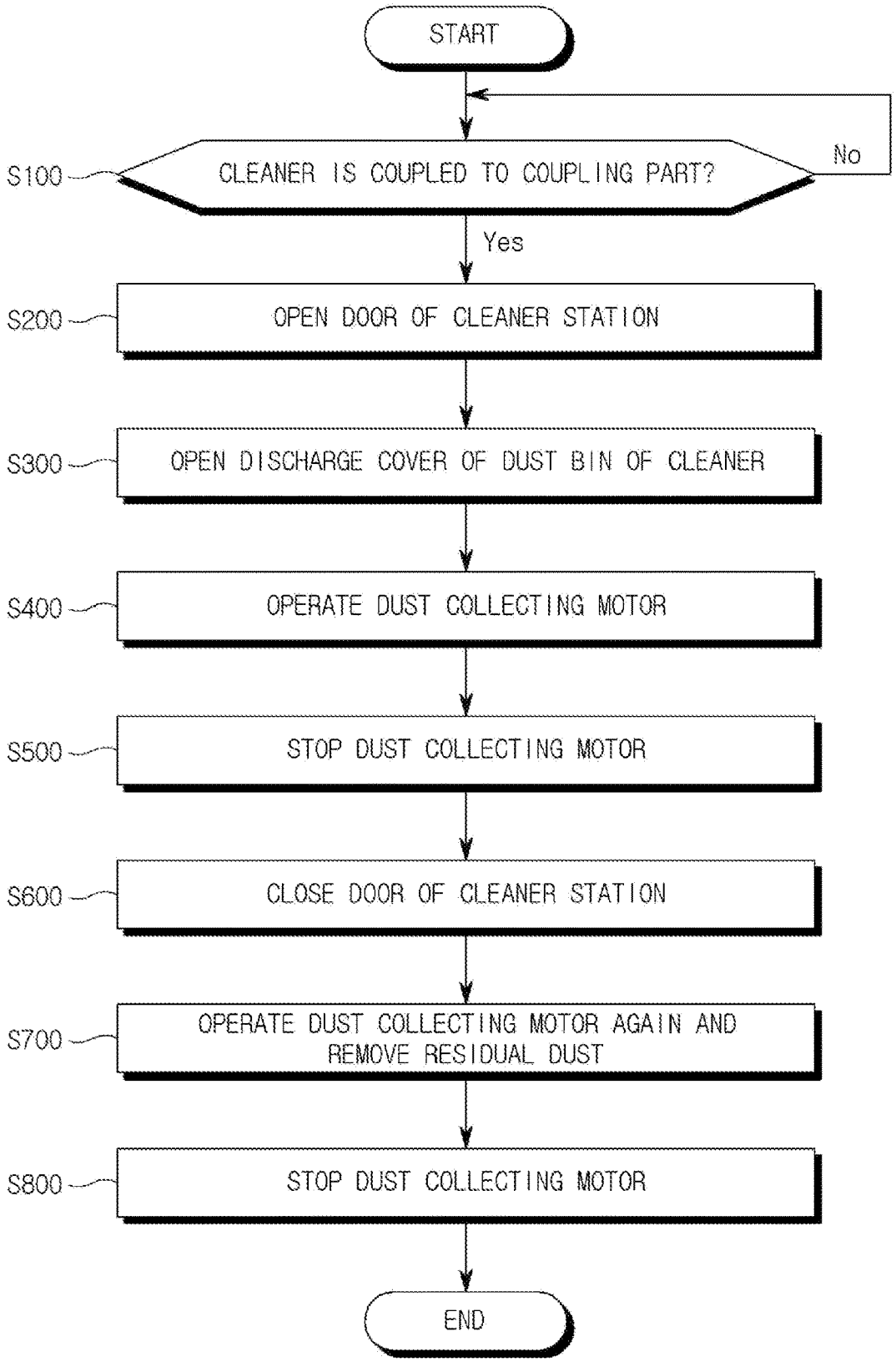
FIG. 14 is a flowchart illustrating an example of a method for removing residual dust using the cleaner system.

FIG. 14 is a flowchart illustrating an example of a method for removing residual dust using the cleaner system 1000.

First, when it is determined that the cleaner 2 is coupled to the coupling part 110 (S100), the door 610 provided in the cleaner station 1 so as to allow the outside and inside of the cleaner station 1 to communicate with each other is opened in a door opening step (S200). In some examples, the door 610 can be opened by the door unit 600 of the cleaner station 1.

In some implementations, a coupling sensor can be disposed on the coupling part 110 to check whether the cleaner 2 is coupled to the coupling part 110. The coupling sensor can be a contact sensor such as a micro-switch or a non-contact sensor such as an infrared sensor.

Next, in a discharge cover opening step, the discharge cover 2620 for opening or closing the dust bin 2600 is opened (S300). In some examples, the discharge cover 2620 can be opened by the cover opening unit 500 of the cleaner station 1.

When both the door 610 and the discharge cover 2620 are opened and the interior of the dust bin body 2610 communicates with the suction tube 700, the dust collecting motor 200 operates to suction the dust into the cleaner station 1 in a dust collecting step (S400). The dust collecting motor 200 can operate for the predetermined first time t1. In some examples, the air containing the dust can pass through the main suction route and the bypass suction route and flow to the suction tube 700, and the dust can be trapped in the dust bag 310.

When the dust collecting motor 200 stops operating after the first time t1 elapses (S500), the door unit 600 can close the door 610 together with the discharge cover 2620 in a door closing step (S600). When the door arm 620 of the door unit 600 pushes the door 610 in the direction in which the door 610 is closed, the discharge cover 2620 also moves in the direction in which the dust bin 2600 is closed, such that the discharge cover 2620 is coupled to the dust bin body 2610 again, and the door 610 also closes the dust passage hole 113*a*.

In some implementations, after the door closing step, a residual dust removing step of removing the residual dust existing at the periphery of the dust bin 2600 is performed (S700).

In some implementations, the residual dust removing step is a process of suctioning the residual dust into the cleaner station 1 by operating the dust collecting motor 200 again for a predetermined time in the state in which the cleaner 2 is coupled to the cleaner station 1. For example, in the state in which the dust bin 2600 is coupled to the coupling part 110 after the door 610 is closed by the door unit 600, the dust collecting motor 200 can operate again for the second time t2 to generate the suction force. In some implementations, since the main suction route is in the closed state, the air containing the dust flows into the suction tube 700 by passing only through the bypass suction route while the dust collecting motor 200 operates again. Therefore, the suction force can be more greatly concentrated on the bypass suction route when the dust collecting motor 200 generates a constant suction force. That is, since the dust collecting motor 200 operates again in the state in which the discharge cover 2620 and the door 610 are closed, the suction force applied to the residual dust increases, which can help to improve the efficiency in removing the residual dust.

In some implementations, the bypass suction route can be a route through which the residual dust flowing into the second coupling part 112 is suctioned into the suction tube 700 through the bypass hole 710, i.e., a route through which the residual dust flowing into the coupling lever 2630 is suctioned into the suction tube 700 through the dust discharge groove 2632*a* and the bypass hole 710.

Further, the first time t1 and the second time t2 can each be a predetermined time preset by the control unit of the cleaner station 1. In some implementations, the first time t1 for which a large amount of dust needs to be suctioned can be equal to or longer than the second time t2 for which the residual dust is suctioned. The control unit can be accommodated in the housing 100 and control the operation, the stopping operation, and the suction force of the dust collecting motor 200.

In some implementations, when the second time t2 elapses, the dust collecting motor 200 is stopped (S800), and the overall operation of the cleaner station 1 is ended.

In some implementations, the residual dust accumulated at the periphery of the push protrusion in the cleaner station can be effectively suctioned through the bypass hole that penetrates the outside and inside of the suction tube.

In some implementations, the residual dust accumulated inside the coupling lever disposed outside the dust bin of the cleaner can be effectively removed through the dust discharge groove formed in the coupling lever of the cleaner.

In some implementations, the dust collecting motor operates again for a predetermined time in the residual dust removing step after the process of suctioning the dust in the dust bin is ended and the discharge cover is closed. Therefore, the suction force for suctioning the residual dust can be concentrated on the bypass hole and the dust discharge groove, which can help to more effectively remove the residual dust.

While the specific implementations of the present disclosure have been described and illustrated, it is obvious to those skilled in the art that the present disclosure is not limited to the aforementioned implementations and can be variously changed and modified without departing from the spirit and the scope of the present disclosure. Therefore, the scope of the present disclosure should be determined by the technical spirit of the appended claims instead of being determined by the described implementation.

What is claimed is:

1. A cleaner system comprising:

a cleaner comprising a dust bin, the dust bin being configured to receive dust; and a cleaner station configured to couple to the cleaner and to remove the dust in the dust bin, wherein the dust bin comprises:

a dust bin body that has a cylindrical shape and defines an opening at one side thereof, and a discharge cover rotatably coupled to the dust bin body and configured to cover the opening, wherein the cleaner station comprises:

a housing, a coupling part recessed from a surface of the housing and configured to couple to at least a part of the cleaner, a suction tube disposed in an upward-downward direction in the housing and connected to the coupling part, and a door coupled to the coupling part and configured to rotate relative to the coupling part, wherein the coupling part defines:

a main hole configured to communicate with an outside of the housing and an inside of the suction tube, the main hole being defined at a position configured to face the dust bin based on the cleaner being coupled to the coupling part, and a bypass suction route including a bypass hole that is located below the main hole and in communication with the outside of the housing and the inside of the suction tube, the bypass suction route being free of any structure that prevents airflow through the bypass suction route from flowing, and wherein the discharge cover is configured to open and close the main hole based on rotation of the door.

2. The cleaner system of claim 1, wherein the cleaner station further comprises a dust collecting motor accommodated in the housing and configured to generate a suction force for suctioning the dust in the dust bin through the suction tube, and wherein the door is configured to:

rotate in a first direction relative to the coupling part to thereby open the main hole based on the cleaner being coupled to the coupling part; and rotate in a second direction opposite to the first direction to thereby close the main hole based on completion of an operation of the dust collecting motor.

3. The cleaner system of claim 1, wherein the cleaner station further comprises a dust collecting motor accommodated in the housing and configured to generate a suction force for suctioning the dust in the dust bin through the suction tube, and wherein the dust collecting motor is configured to:

operate for a predetermined first time in a state in which the main hole is opened to thereby provide the suction force to both of the main hole and the bypass hole; and after operating for the predetermined first time, operate for a predetermined second time in a state in which the main hole is closed to thereby provide the suction force to the bypass hole.

4. The cleaner system of claim 3, wherein the door is configured to maintain the main hole to be opened for the predetermined first time.

5. The cleaner system of claim 3, wherein the cleaner station has:

a main suction route configured to carry air containing dust into an internal space of the suction tube through the main hole; and the bypass suction route configured to carry air containing dust into the internal space of the suction tube through the bypass hole, and wherein the dust collecting motor is configured to:

based on the main hole being opened, suction air containing dust through both of the main suction route and the bypass suction route, and based on the main hole being closed, suction air containing dust through the bypass suction route.

6. The cleaner system of claim 1, wherein the door is configured to:

rotate relative to the coupling part in a direction from a state in which the main hole is closed; and rotate together with the discharge cover to thereby open or close the dust bin of the cleaner.

7. The cleaner system of claim 1, wherein a cross-sectional area of the bypass hole is less than a cross-sectional area of the main hole.

8. The cleaner system of claim 1, wherein the cleaner station further comprises a push protrusion configured to press the discharge cover to thereby open the dust bin based on the cleaner being coupled to the coupling part, and wherein the bypass hole is configured to face the push protrusion in a direction in which the push protrusion presses the discharge cover.

* * * * *